US010028341B2

(12) United States Patent
Kim

(10) Patent No.: US 10,028,341 B2
(45) Date of Patent: Jul. 17, 2018

(54) POWER DEVICE AND METHOD FOR CONTROLLING OUTPUT CURRENT OF THE SAME

(71) Applicant: LG INNOTEK CO., LTD., Seoul (KR)

(72) Inventor: Jun Seong Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/361,786

(22) Filed: Nov. 28, 2016

(65) Prior Publication Data

US 2017/0171926 A1 Jun. 15, 2017

(30) Foreign Application Priority Data

Dec. 15, 2015 (KR) ..... 10-2015-0179502

(51) Int. Cl.
*H05B 33/08* (2006.01)

(52) U.S. Cl.
CPC ..... *H05B 33/0815* (2013.01)

(58) Field of Classification Search
CPC ..... H05B 33/0815
USPC ..... 315/297
See application file for complete search history.

(56) References Cited

U.S. PATENT DOCUMENTS 9,288,853 B2 * 3/2016 Yu ..... H05B 33/0815
2011/0248648 A1 * 10/2011 Liu ..... G09G 3/3406 315/294
2011/0285323 A1 * 11/2011 Kuo ..... H05B 33/0815 315/307
2013/0193877 A1 * 8/2013 Kuo ..... H05B 33/0818 315/307
2013/0278145 A1 * 10/2013 Lin ..... H05B 33/0851 315/122
2014/0091723 A1 * 4/2014 Kuo ..... H05B 33/0857 315/200 R
2014/0232270 A1 * 8/2014 Kimura ..... H05B 33/0815 315/122
2014/0265909 A1 * 9/2014 Sadwick ..... H05B 33/0887 315/224
2014/0354186 A1 * 12/2014 Sun ..... H05B 33/0815 315/310

FOREIGN PATENT DOCUMENTS

CN 102427633 A 4/2012
CN 103997812 A 8/2014

OTHER PUBLICATIONS

SIPO Office Action, dated Mar. 19, 2018, for Chinese Patent Application No. 201611151275.0, which corresponds to the above-identified U.S. application.

* cited by examiner

*Primary Examiner* — Dylan White
(74) *Attorney, Agent, or Firm* — LRK Patent Law Firm

(57) ABSTRACT

A power device includes a converter configured to convert an input voltage and operate a light emitting diode (LED) array, a current detector configured to detect an output current flowing through the LED array, and a controller configured to compare the output current with a reference value and control the output current, wherein the controller includes a reference value varying circuit configured to vary the reference value.

12 Claims, 12 Drawing Sheets

POWER DEVICE AND METHOD FOR CONTROLLING OUTPUT CURRENT OF THE SAME

CROSS-REFERENCE TO RELATED APPLICATION

This application claims priority to and the benefit of Korean Patent Application No. 2015-0179502, filed on Dec. 15, 2015, the disclosure of which is incorporated herein by reference in its entirety.

BACKGROUND

1. Field of the Invention

The present disclosure related to a power device for a light emitting diode (LED), and more particularly, to a power device for an LED and a method for controlling an output current of the same.

2. Description of Related Art

Fluorescent lamps, incandescent lamps, light emitting diodes (LEDs), and the like are used in indoor and outdoor lighting devices. Among these, a lighting device using an LED has advantages of low consumption power and a semipermanent lifetime compared to a lighting device using a fluorescent lamp.

A lighting device using an LED requires a power device for supplying a voltage. A power device for an LED converts an input voltage, supplies the converted voltage to an LED array including a plurality of LEDs, and then operates the LED array.

Meanwhile, a lighting device using an LED may be variously applied to a home, a building, a street lamp, a performance hall, and the like, and a required output current thereof may be different according to an application field or a tendency of a customer.

However, since an output voltage of a lighting device using an LED is fixed in advance, there is a problem in that an output current of the lighting device is not easily adjusted.

SUMMARY OF THE INVENTION

To address the above described problem, an object of the present disclosure is to provide a power device for a light emitting diode (LED) and a method for controlling an output current of the same.

A power device according to one embodiment includes a converter configured to convert an input voltage and operate a light emitting diode (LED) array, a current detector configured to detect an output current flowing through the LED array, and a controller configured to compare the output current with a reference value and control the output current, wherein the controller includes a reference value varying circuit configured to vary the reference value.

The converter may include a switch, and the controller may control a turn on operation and a turn off operation of the switch.

The output current may be controlled by a turned on time and a turned off time of the switch.

The turned on time and the turned off time of the switch may be varied by the reference value.

The controller may further include an operational amplifier configured to perform an operational amplification on the output current and the reference value, and a comparator configured to compare an output value of the operational amplifier with a value of a ramp generator, wherein the turn on operation and the turn off operation of the switch may be controlled according to an output value of the comparator.

The reference value varying circuit may include a variable resistor.

The reference value varying circuit may vary the reference value according to a voltage divided by the variable resistor.

The reference value varying circuit may further include a transistor.

The reference value varying circuit may vary an amplification value of the transistor by means of the variable resistor to vary the reference value.

The transistor may be a bipolar junction transistor (BJT) or a field effect transistor (FET).

One end of the variable resistor may be connected to a base of the BJT or to a gate of the FET.

The output current may be controlled by a duty ratio (D), which is a turned on time ($T_{on}$) of the switch with respect to one time period (T).

A method for controlling an output current of a power device according to one embodiment of the present disclosure, includes converting an input voltage and operating an LED array, detecting an output current flowing through the LED array, and comparing the output current with a reference value and controlling the output current, wherein the reference value is varied by a reference value varying circuit.

The operating may include converting the input voltage through a capacitor and an inductor and operating the LED array when a switch is turn on, and circulating energy stored in the inductor to operate the LED array when the switch is turned off.

The controlling may control a turn on operation and a turn off of the switch using the comparison result.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
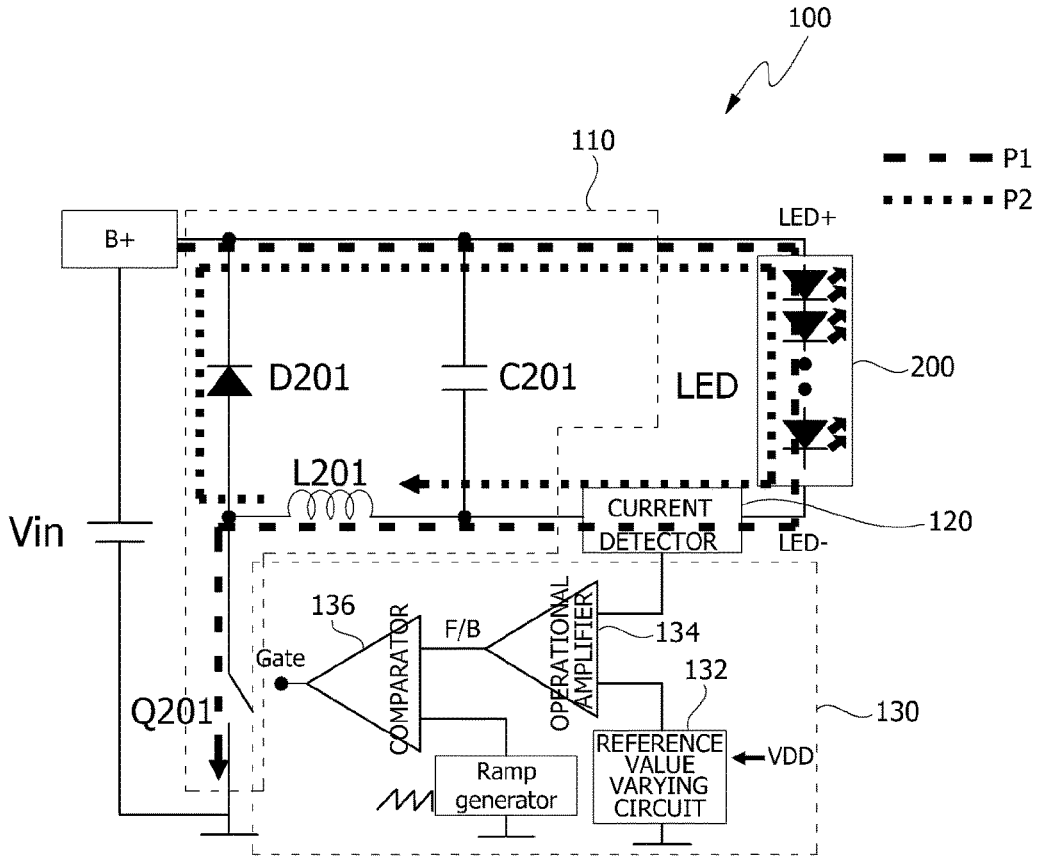
FIG. 1 is a diagram of a power device for a light emitting diode (LED) according to one embodiment of the present disclosure.

The present disclosure may be modified in various forms and may have a variety of embodiments, and therefore, specific embodiments will be illustrated in the drawings and a description thereof will be described in the following detailed description. However, the embodiments that will be disclosed below are not to be taken in a sense that limits the present disclosure to specific embodiments and should be construed as including modifications, equivalents, or substituents within the spirit and technical scope of the present disclosure.

Terms including ordinal terms such as a second, a first, and the like may be used to describe various components, but these components are not limited by the terms. These terms are used only for the purpose of discriminating one component from another component. For example, a second component may be referred to as a first component, and similarly, a first component may also be referred to as a second component without departing from the scope of the present disclosure. The term "and/or" includes a combination of a plurality of described items related thereto or any one item among the plurality of described items related thereto.

When a component is described as being "coupled" or "connected" to another component, the component can be directly coupled or connected to the other component, but it should be understood that another component(s) could exist therebetween. On the other hand, when a component is disclosed as "directly coupled" or "directly connected" to another component, the component can be directly coupled or connected to the other component, but it should be understood that another component(s) could exist therebetween.

The terms used herein are not to be taken in a sense that limits the technical concept of the present disclosure, but as an explanation thereof. An expression of a singular form should be understood as including the plural form unless specifically defined otherwise in context. Throughout the disclosure, the terms "comprise" and/or "have" specify the presence of characteristics, digits, steps, operations, components, parts, or a combination thereof, but do not preclude the presence or addition of one or more of characteristics, digits, steps, operations, components, parts, or a combination thereof.

Unless otherwise defined, all terms including technical or scientific terms used herein have the same meaning as commonly understood by those skilled in the art to which the present disclosure pertains. General terms that are defined in a dictionary should be construed as having meanings that are consistent in the context of the relevant art, and are not to be interpreted as having an idealistic or excessively formalistic meaning unless clearly defined otherwise in the present application.

Hereinafter, embodiments according to the present disclosure will be described in detail with reference to the accompanying drawings, and the same reference numerals are given to the same or corresponding components regardless of reference numerals thereof, and a repetitive description thereof will be omitted.

Figure 2:
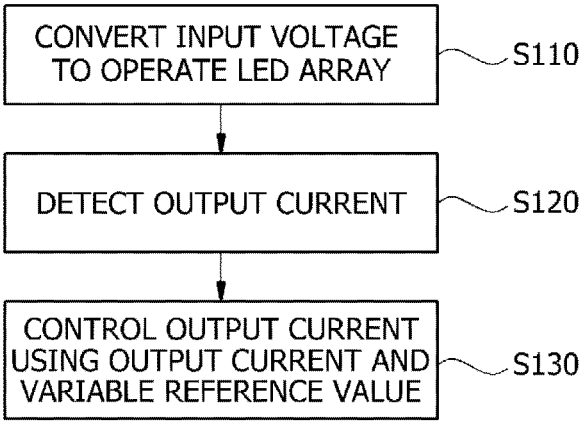
FIG. 2 is a diagram illustrating a method for controlling an output current of a power device for an LED according to one embodiment of the present disclosure.

FIG. 1 is a diagram of a power device for a light emitting diode (LED) according to one embodiment of the present disclosure, and FIG. 2 is a diagram illustrating a method for controlling an output current of a power device for an LED according to one embodiment of the present disclosure.

Referring to FIGS. 1 and 2, a power device 100 for an LED includes a converter 110, a current detector 120, and a controller 130.

The convert 110 converts an input voltage $V_{in}$ and operates an LED array 200 in Operation S110. The current detector 120 detects an output current flowing through the LED array 200 in Operation S120. Further, the controller 130 compares a value detected by the current detector 120 with a reference value and controls the output current in Operation S130.

Here, the current detector 120 may be connected between the LED array 200, the convert 110, and the controller 130.

For convenience of a description, an example in which the convert 110 is a buck converter will be described, but the present disclosure is not limited thereto.

The convert 110 includes a switch Q201, an inductor L201, and a capacitor C201. The inductor L201 and the capacitor C201 are an inductor-capacitor (LC) filter serving a function of a low pass filter and serve to apply a direct current (DC) to the LED array 200. Meanwhile, when the switch Q201 is turned on, an input voltage is converted through the convert 110 and is then applied to the LED array 200. As a result, a current passes through the LED array 200 and the current detector 120 along a path P1 and is then stored in the inductor L201.

Further when the switch Q201 is turned off, energy stored in the inductor L201 is discharged and is then supplied to the LED array 200 through a circulating diode D201 along a path P2.

Figure 3:
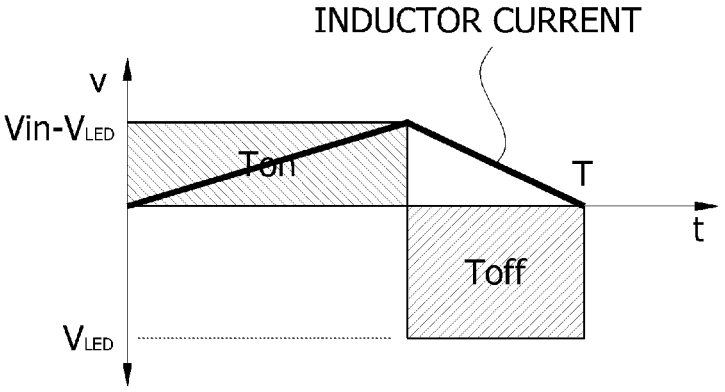
FIG. 3 is a graph illustrating energy variance in an inductor L201 according to a turn on operation and a turn off operation of a switch Q201.

FIG. 3 is a graph illustrating energy variance in the inductor L201 according to a turn on operation and a turn off operation of the switch Q201.

Referring to FIG. 3, when the switch Q201 is turned on, a difference in potential across both ends of the inductor L201 is the same as a value that is obtained by subtracting a voltage $V_{LED}$, which is applied to the LED array 200, from the input voltage $V_{in}$. Further, when the switch Q201 is turned off, the difference in potential across the both ends of the inductor L201 is the same as the voltage $V_{LED}$ which is applied to the LED array 200. Since an amount of energy stored in the inductor L201 when the switch Q201 is turned on is the same as that of energy discharged from the inductor L201 when the switch Q201 is turned off, Equation 1 may be represented as follows.

$$(V_{in}-V_{LED})T_{on}=V_{LED}\times T_{off} \quad \text{[Equation 1]}$$

Here, $V_{in}$ is the input voltage, $V_{LED}$ is a voltage applied between both ends of the LED array 200, $T_{on}$ is a time during which the switch Q201 is turned on, and $T_{off}$ is a time during which the switch Q201 is turned off.

Equation 1 may be represented as Equation 2.

$$V_{in}T_{on}-V_{LED}T_{on}=V_{LED}(T-T_{on}) \quad \text{[Equation 2]}$$

Here, T represents one time period $T_{on}+T_{off}$.

Further, Equation 2 may be represented as Equation 3.

$$V_{LED}=V_{in}D \quad \text{[Equation 3]}$$

Here, D represents $T_{on}/T$, that is, a duty ratio.

Consequently, the voltage applied between both ends of the LED array 200, that is, an output voltage, may be varied according to a duty ratio D. This is because the output current flowing through the LED array 200 varies according to the duty ratio (D).

Figure 4:
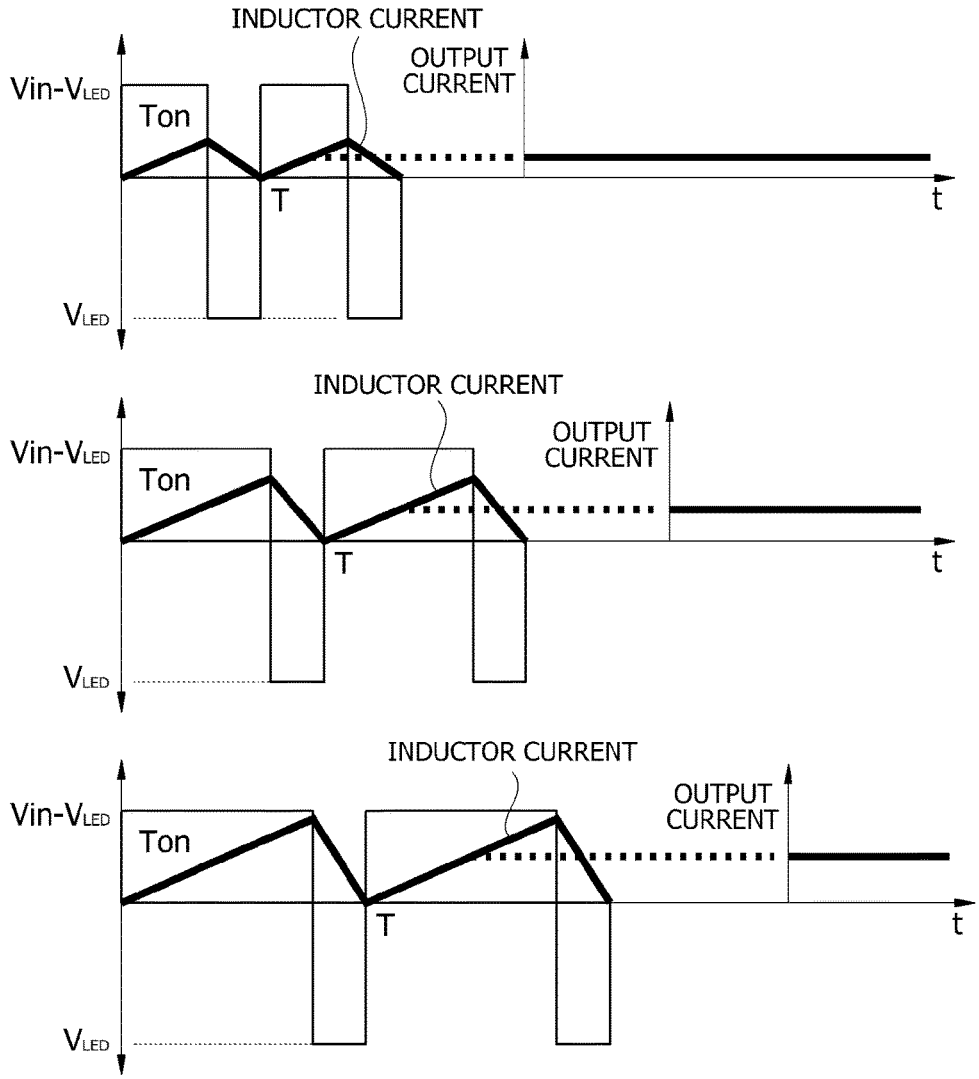
FIG. 4 is a diagram illustrating an output current flowing through an LED array 200 according to a duty ratio (D)

FIG. 4 is a diagram illustrating an output current flowing through the LED array 200 according to the duty ratio (D).

Referring to FIG. 4, it can be seen that the output current varies according to the duty ratio (D).

For example, it can be seen that the output current is increased in comparison to the one time period T as the time during which the snitch Q201 is turned on is lengthened whereas the output current is decreased in comparison to the one time period (T) as the time during which the switch Q201 is turned on is shortened.

This can be seen through Equation 4.

$$V_L = L\frac{di_L}{dt} \quad \text{[Equation 4]}$$

Here, $V_L$ is a voltage applied between both ends of the inductor L201, and L is an inductance of the inductor L201. Equation 4 may be derived as Equation 5.

$$di_L = \frac{V_L}{L}dt \quad \text{[Equation 5]}$$

From the above Equations, it can be seen that a current $i_p$ flowing at the inductor L201 in a condition of being turned-on is represented by Equation 6, and a current $i_p$ flowing at the inductor L201 in a condition of being turned-off is represented by Equation 7.

$$i_p = \frac{V_{in} - V_{LED}}{L}T_{on} \quad \text{[Equation 6]}$$

$$i_p = \frac{V_{LED}}{L}(T - T_{on}) \quad \text{[Equation 7]}$$

Since there is a correlation between a current flowing at the inductor L201 and an output current flowing through the LED array 200 in the conditions of being turned-on and turned-off, the duty ratio (D) may be adjusted to control the output current flowing through the LED array 200.

As described above, in accordance with one embodiment of the present disclosure, the output, current flowing through the LED array 200 is controlled by controlling the duty ratio (D).

For this purpose, the controller 130 of the power device 100 according to one embodiment of the present disclosure controls the turn on operation and the turn off operation of the switch Q201. When the controller 130 controls a turned on time and a turned off time of the switch Q201, the duty ratio (D) may be varied and the output current flowing through the LED array 200 may be controlled.

Referring back to FIG. 1, the controller 130 may include a reference value varying circuit 132 configured to vary a reference value, an operational amplifier 134 configured to perform an operational amplification on the output current detected by the current detector 120 and the reference value controlled by the reference value varying circuit 132, and a comparator 136 configured to compare an output value F/B of the operational amplifier 134 with a value of a ramp generator. Further, the turn on operation and the turn off operation of the switch Q201 may be controlled according to an output value Gate of the comparator 136.

Figure 5:
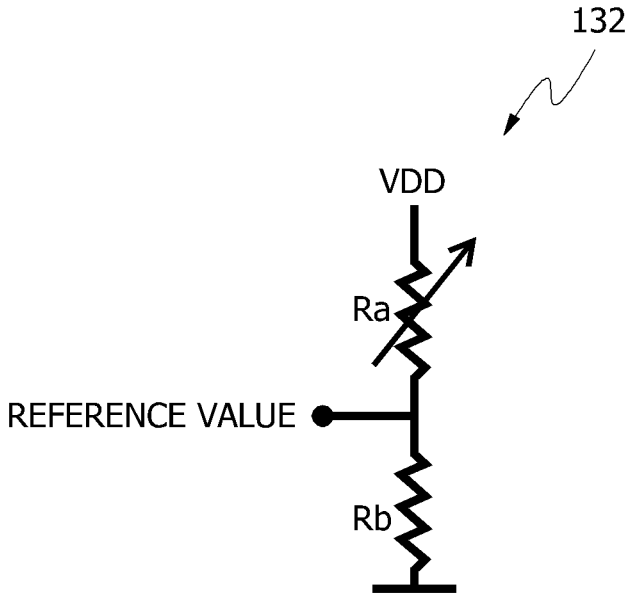
FIG. 5 is one example of a reference value varying circuit varying a reference value according to one embodiment of the present disclosure.
Figure 6:
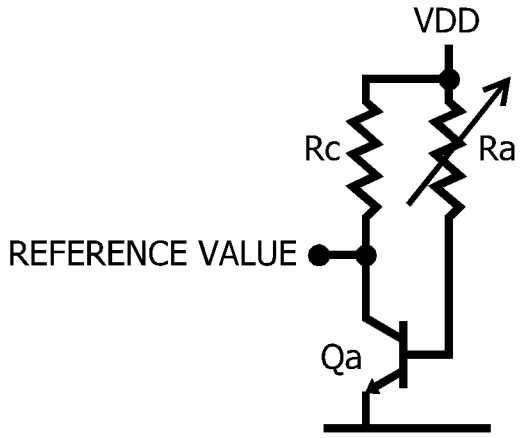
FIG. 6 is another example of a reference value varying circuit varying a reference value according to another embodiment of the present disclosure.

FIG. 5 is one example of a reference value varying circuit varying a reference value according to one embodiment of the present disclosure, and FIG. 6 is another example of a reference value varying circuit varying a reference value according to another embodiment of the present disclosure.

Referring to FIGS. 5 and 6, the reference value varying circuit 132 includes a variable resistor $R_a$.

Referring to FIG. 5, the reference value varying circuit 132 may vary a reference value according to a voltage divided by the variable resistor $R_a$. That is, when a value of the variable resistor $R_a$ is changed, the reference value may also be varied according to a voltage division principle.

Figure 7:
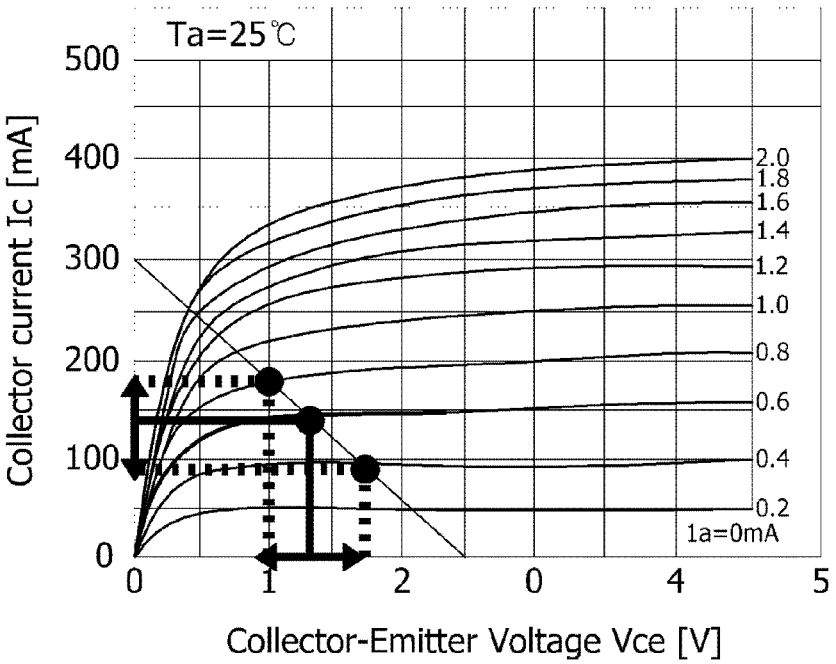
FIG. 7 is an I-V characteristic graph of a transistor Qa.

Referring to FIG. 6, the reference value varying circuit 132 may further include a transistor $Q_a$. An amplification value of the transistor $Q_a$ may be changed by the variable resistor $R_a$ so that the reference value may be varied. For this purpose, one end of the variable resistor $R_a$ may be connected to a base of the transistor $Q_a$. This will be described in detail with reference to an I-V characteristic graph of the transistor $Q_a$, which is shown in FIG. 7. Referring to FIG. 7, when a base current of the transistor $Q_a$ is varied, $V_{ce}$ of the transistor $Q_a$ may be varied. For example, when the base current is increased from 0.6 mA to 0.8 mA, a collector current $I_c$ may be increased and $V_{ce}$ may be decreased. Further, when the base current is decreased from 0.6 mA to 0.4 mA, the collector current $I_c$ may be decreased and $V_{ce}$ may be increased. As described above, the reference value may be changed as $V_{ce}$ of the transistor $Q_a$ is changed. Meanwhile, the base current of the transistor $Q_a$ may be varied by the variable resistor $R_a$. At this point, a resistor $R_c$ may be used as a current limiting resistor. Here, only a bipolar junction transistor (BJT) is exemplified and described, but the present disclosure is not limited thereto. A transistor applied to the reference value varying circuit 132 may be a field effect transistor (FET).

The reference value varying circuit according to one embodiment of the present disclosure may be variously modified. FIGS. 8 to 14 show a variety of embodiments of a reference value varying circuit.

Referring to FIGS. 8 to 14, the reference value varying circuit 132 may include the variable resistor $R_a$, and may vary the reference value using a voltage divided by the variable resistor $R_a$, or by the variable resistor $R_a$ varying a base current or a gate current of a transistor.

Figure 8:
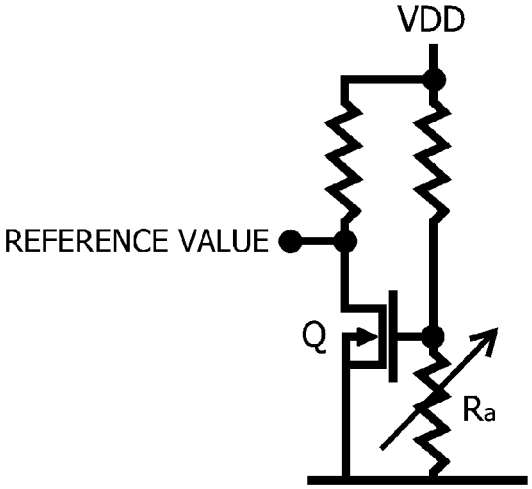
FIGS. 8 to 14 are diagrams illustrating a variety of embodiments of a reference value varying circuit.
Figure 9:
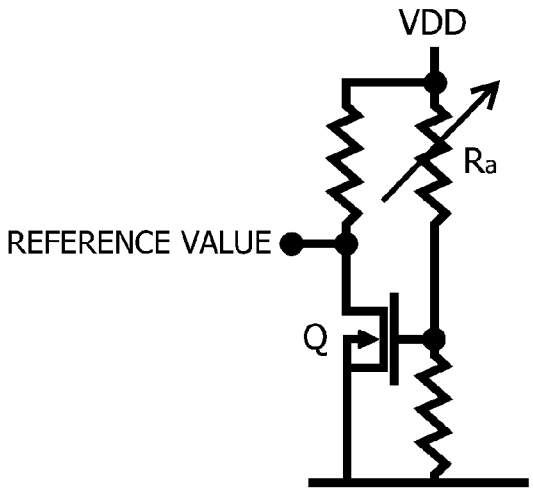

In particular, as shown in FIGS. 8 and 9, the variable resistor $R_a$ is connected in series with a reference value supply power VDD, and one end of the variable resistor $R_a$ is connected to a gate of a transistor Q. Consequently, a voltage applied between a drain of the transistor Q and a source terminal thereof, that is, a reference value, may be varied.

Figure 10:
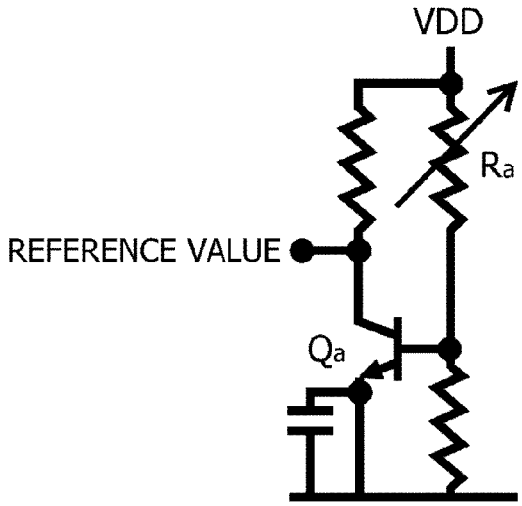
Figure 11:
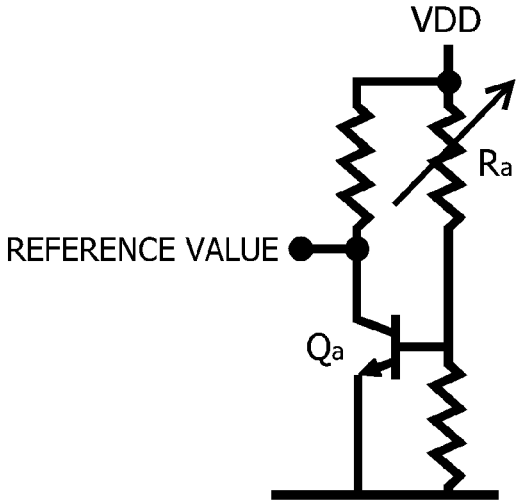
Figure 12:
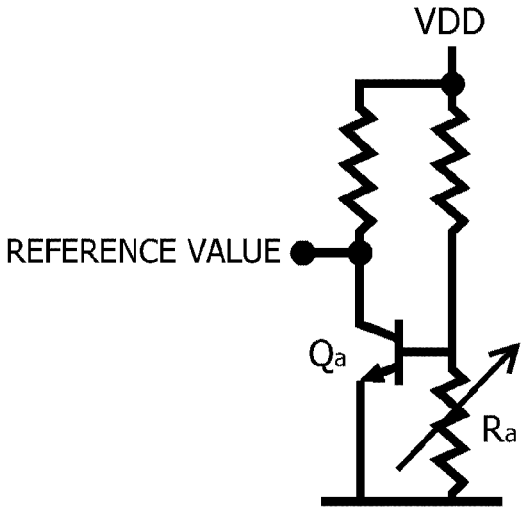

Also, with reference to FIGS. 10 to 12, the variable resistor $R_a$ is connected in series with the reference value supply power VDD, and one end of the variable resistor $R_a$ is connected to a base of the transistor $Q_a$. Consequently, a voltage $V_{ce}$ applied between an emitter of the transistor $Q_a$ and a collector thereof, that is, a reference value, may be varied.

Figure 13:
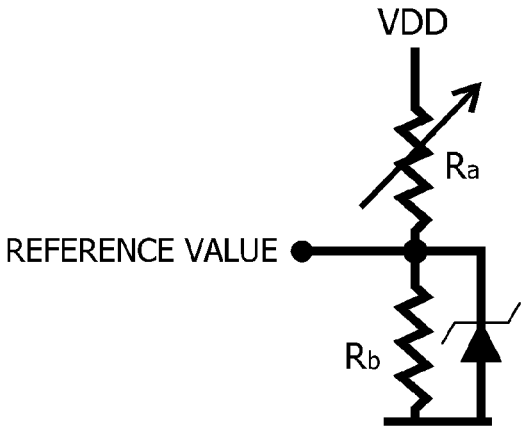

In addition, with reference with FIG. 13, one end of the variable resistor $R_a$ is connected to the reference value supply power VDD, and a resistor $R_b$ and a Zener diode are connected in parallel with the other end of the variable resistor $R_a$. Consequently, a reference value may be varied.

Figure 14:
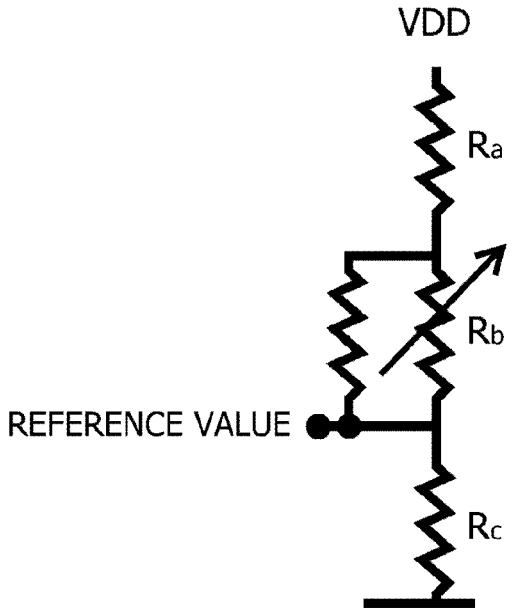

Also, with reference to FIG. 14, the variable resistor Ra and the resistors $R_b$ and $R_c$ are connected to a reference value supply power VDD. A reference value may be varied according to a voltage divided by the variable resistor $R_a$.

Figure 15:
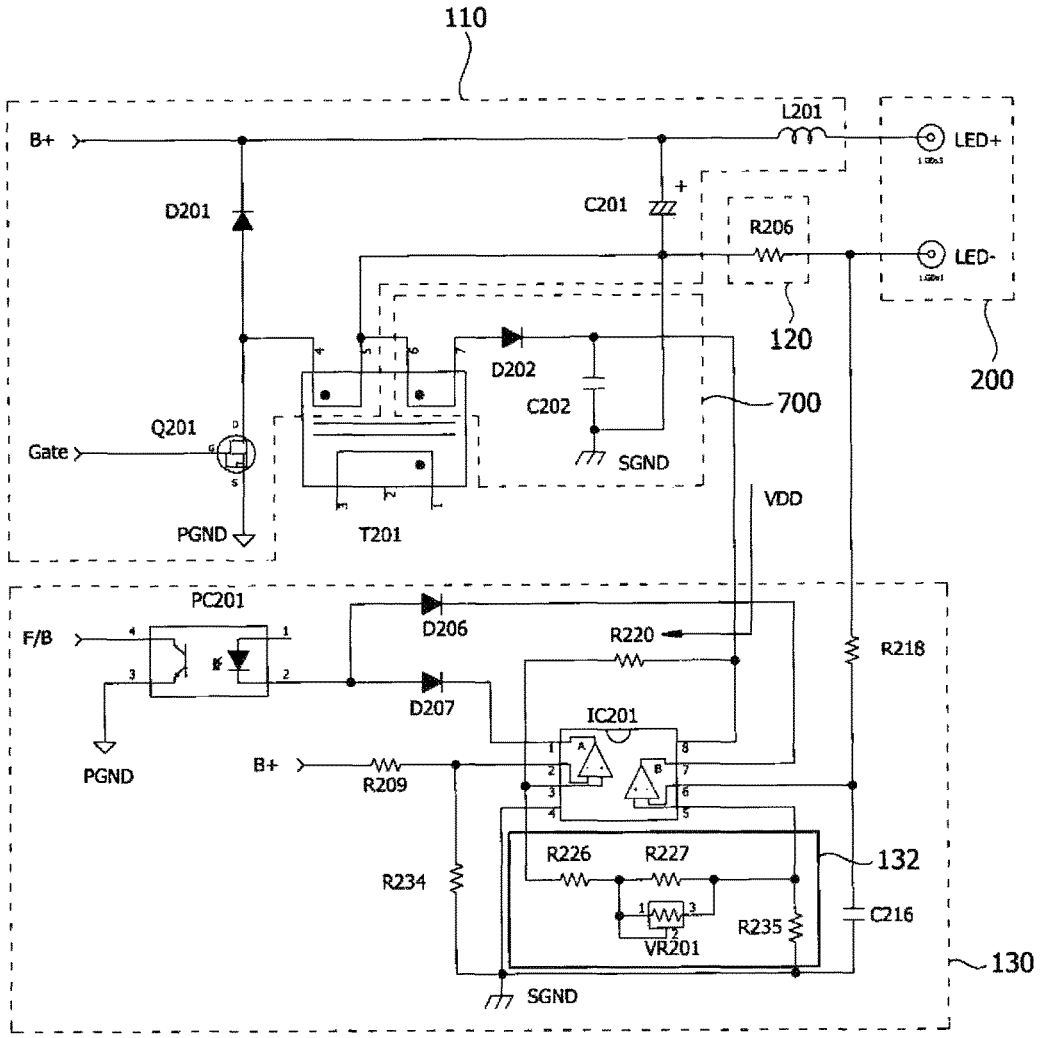
FIG. 15 is a diagram illustrating a power device for an LED to which a reference value varying circuit is applied according to one embodiment of the present disclosure.

FIG. 15 is a diagram illustrating a power device for an LED to which a reference value varying circuit is applied according to one embodiment of the present disclosure.

Referring to FIG. 15, when the switch Q201 is turned on, an input voltage is converted through the capacitor C201 and the inductor L201 and then operates the LED array 200. Further, when the switch Q201 is turned off, energy stored in the inductor L201 operates the LED array 200 through the circulating diode D201.

Meanwhile a current detector R206 (also 120) detects an output current flowing at the LED array 200.

The output current detected by the current detector R206 (also 120) is input to operational amplifiers IC201 (also 134) of the controller 130. Also, the reference value supply power VDD may be input to the operational amplifiers IC201 (also 134) via the reference value varying circuit 132.

Figure 16:
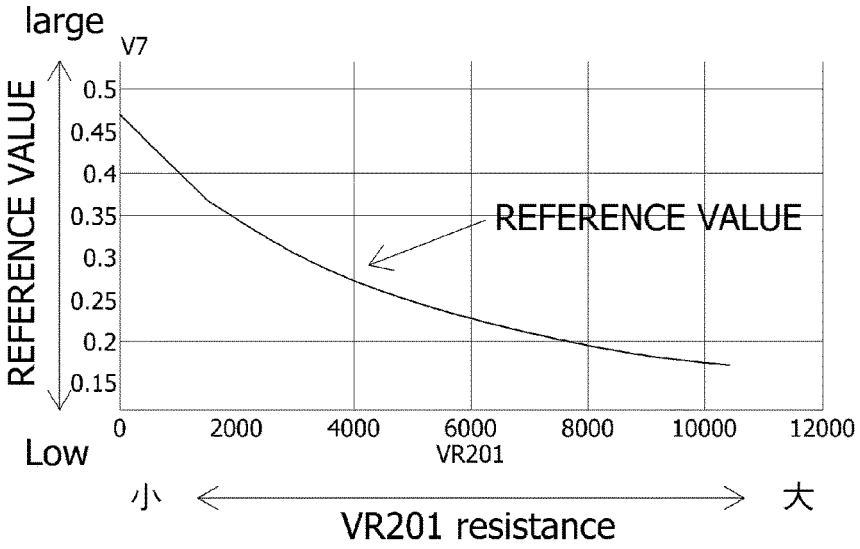
FIG. 16 is a graph illustrating the fact that a reference value is lowered when a variable resistance value of the reference value varying circuit exemplified in FIG. 15 is increased.

Here, the reference value varying circuit 132 may include a resistor R226 connected in series and a variable resistor VR201, and a reference value being input to the operational amplifiers IC201 (also 134) may be varied by the resistor R226 and the variable resistor VR201 according to a voltage division principle. FIG. 16 is a graph illustrating the fact that the reference value is lowered when the variable resistance value of the reference value varying circuit exemplified in FIG. 15 is large.

A value Gate may be output by the output value F/B of the operational amplifiers IC201 (also 134) so that the turn on operation and the turn off operation of the switch Q201 may be controlled by the value Gate.

Further, an output current flowing at a plurality of LEDs of the LED array 200 may be varied according to the turned on time and the turned off time of the switch Q201.

Figure 17:
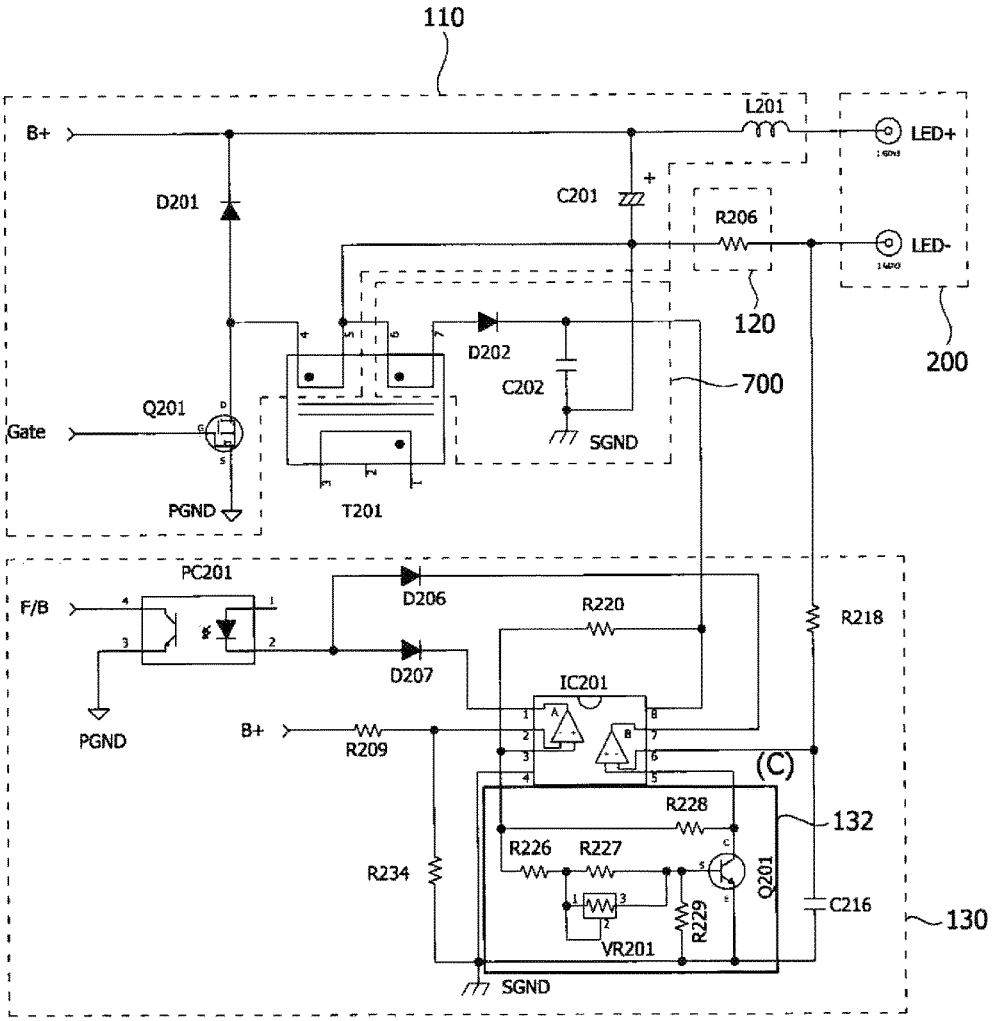
FIG. 17 is a diagram illustrating a power device for an LED to which a reference value varying circuit according to another embodiment of the present disclosure is applied.

FIG. 17 is a diagram illustrating a power device 100 for an LED to which a reference value varying circuit according to another embodiment of the present disclosure is applied.

Referring to FIG. 17, when a switch Q201 is turned on, an input voltage is converted through a capacitor C201 and an inductor L201 to operate an LED array 200. Further, when the switch Q201 is turned off, energy stored in the inductor L201 operates the LED array 200 through a circulating diode D201.

Meanwhile, a current detector R206 (also 120) detects an output current flowing at the LED array 200.

The output current detected by the current detector R206 (also 120) is input to operational amplifiers IC201 (also 134) of a controller 130. Also, a reference value supply power VDD may be input to the operational amplifiers IC201 (that is, 134) via a reference value varying circuit 132.

Figure 18:
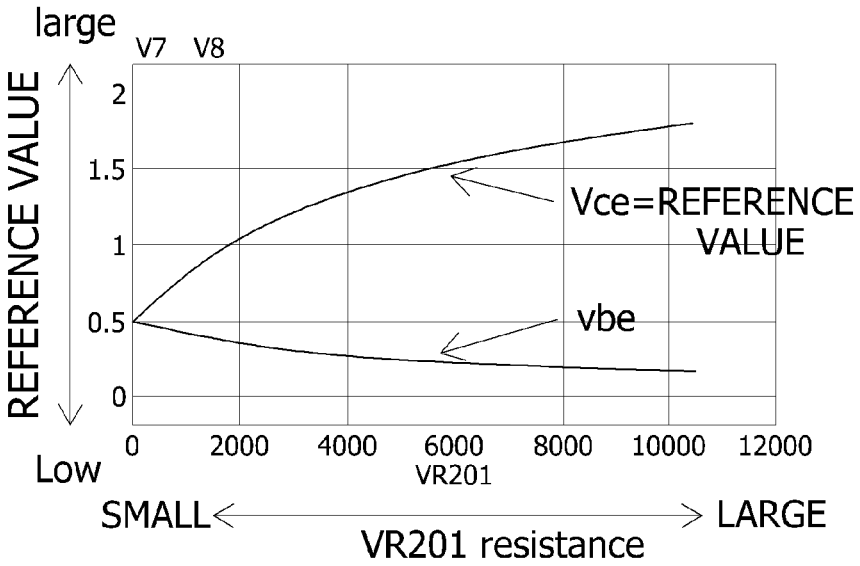
FIG. 18 is a graph illustrating that $V_{ce}$ is increased when $V_{be}$ of the transistor $Q_a$ is lowered by a variable resistance value of the reference value varying circuit exemplified in FIG. 17 being increased.

Here, the reference value varying circuit 132 includes a resistor R226, a variable resistor VR201, and a transistor $Q_a$. At this point, the variable resistor VR201 may be connected to a base of the transistor $Q_a$. When a base current of the transistor $Q_a$ is varied by the variable resistor VR201, a reference value input to the operational amplifiers IC201 (also, 134) may be varied. FIG. 18 is a graph illustrating that $V_{ce}$ is increased when $V_{be}$ of the transistor $Q_a$ is lowered by the variable resistance value of the reference value varying circuit 132 exemplified in FIG. 17 being increased.

A value Gate may be output by the output value F/B of the operational amplifier 134 so that the turn on operation and the turn off operation of the switch Q201 may be controlled by the value Gate.

Further, the output current flowing at a plurality of LEDs of the LED array 200 may be varied according to the turned on time and the turned off time of the switch Q201.

As described above, in accordance with the embodiments of the present disclosure, the reference value being input to the controller 130 is varied so that the switch Q201 may be controlled to turn on or off the power device 100. As a result, the output current flowing at the LED array 200 may be controlled.

The power device for an LED according to the embodiments of the present disclosure may control an output current applied to an LED array. Consequently, power efficiency of a lighting device using an LED may be increased, and various needs of customers may be satisfied.

Although the present disclosure has been described with reference to the preferred embodiments, those skilled in the art should understand that various alternation and modifications can be certainly devised without departing from the spirit and scope of this disclosure defined by the appended claims.

What is claimed is:

1. A power device comprising:

a converter configured to convert an input voltage and operate a light emitting diode (LED) array;

a current detector configured to detect an output current flowing through the LED array; and a controller configured to compare the output current with a reference value and control the output current, wherein the converter includes a switch, and the controller controls a turn on operation and a turn off operation of the switch, wherein the controller includes:

a reference value varying circuit configured to vary the reference value;

an operational amplifier configured to perform an operational amplification on the output current and the reference value; and a comparator configured to compare an output value of the operational amplifier with a value of a ramp generator, wherein the turn on operation and the turn off operation of the switch are controlled according to an output value of the comparator, wherein the reference value varying circuit includes a variable resistor and a transistor, and wherein the reference value varying circuit varies an amplification value of the transistor by the variable resistor to vary the reference value.

2. The power device of claim 1, wherein the output current is controlled by a turned on time and a turned off time of the switch.

3. The power device of claim 2, wherein the turned on time and the turned off time of the switch are varied by the reference value.

4. The power device of claim 1, wherein the reference value varying circuit varies the reference value according to a voltage divided by the variable resistor.

5. The power device of claim 1, wherein the transistor is a bipolar junction transistor (BJT) or a field effect transistor (FET).

6. The power device of claim 5, wherein one end of the variable resistor is connected to a base of the BJT or to a gate of the FET.

7. The power device of claim 1, wherein the output current is controlled by a duty ratio (D) which is a turn on time ($T_{on}$) of the switch with respect to one time period (T).

8. A method for controlling an output current, of a power device, the method comprising:

operating an LED array by converting an input voltage by a converter;

detecting an output current flowing through the LED array; and controlling the output current by comparing the output current with a reference value by a controller, wherein the reference value is varied by a reference value varying circuit, wherein the converter includes a switch, and the controller controls a turn on operation and a turn off operation of the switch, wherein the controller includes:

an operational amplifier configured to perform an operational amplification on the output current and the reference value; and a comparator configured to compare an output value of the operational amplifier with a value of a ramp generator, wherein the turn on operation and the turn off operation of the switch are controlled according to an output value of the comparator, wherein the reference value varying circuit includes a variable resistor and a transistor, and wherein the reference value varying circuit varies the reference value by varying an amplification value of the transistor by the variable resistor.

9. The method of claim 8, wherein the reference value varying circuit varies the reference value according to a voltage divided by the variable resistor.

10. The method of claim 8, wherein the operating includes:

operating the LED array when a switch is turned on by converting the input voltage through a capacitor and an inductor; and operating the LED array by circulating energy stored in the inductor when the switch is turned off.

11. The method of claim 10, wherein the controlling controls a turn on operation and a turn off operation of the switch using the comparison result.

12. The method of claim 11, wherein the output current is controlled by a duty ratio (D) which is a turned on time ($T_{on}$) of the switch with respect to one time period (T).

* * * * *